US011536234B2

(12) United States Patent
Werger

(10) Patent No.: US 11,536,234 B2
(45) Date of Patent: Dec. 27, 2022

(54) INJECTOR ARRANGEMENT

(71) Applicant: Robert Bosch GmbH, Stuttgart (DE)

(72) Inventor: Heinrich Werger, Kuchl (AT)

(73) Assignee: Robert Bosch GmbH, Stuttgart (DE)

( * ) Notice: Subject to any disclaimer, the term of this patent is extended or adjusted under 35 U.S.C. 154(b) by 36 days.

(21) Appl. No.: 17/284,537

(22) PCT Filed: Oct. 10, 2019

(86) PCT No.: PCT/EP2019/077453
§ 371 (c)(1),
(2) Date: Apr. 12, 2021

(87) PCT Pub. No.: WO2020/078817
PCT Pub. Date: Apr. 23, 2020

(65) Prior Publication Data

US 2021/0381478 A1 Dec. 9, 2021

(30) Foreign Application Priority Data

Oct. 17, 2018 (DE) ..... 10 2018 217 768.6

(51) Int. Cl.
*F02M 61/14* (2006.01)
*F02M 53/04* (2006.01)
*F02M 61/18* (2006.01)

(52) U.S. Cl.
CPC ..... *F02M 61/14* (2013.01); *F02M 53/04* (2013.01); *F02M 61/18* (2013.01); *F02M 2200/858* (2013.01)

(58) Field of Classification Search
CPC ..... F02M 61/14; F02M 53/04; F02M 61/18; F02M 2200/858; F02M 2700/077
See application file for complete search history.

(56) References Cited

U.S. PATENT DOCUMENTS 3,841,277 A * 10/1974 Schafer ..... F02M 61/145 123/470
4,296,887 A * 10/1981 Hofmann ..... F02M 61/14 239/397.5

(Continued)

FOREIGN PATENT DOCUMENTS

AT 512667 A1 10/2013
DE 102013021261 A1 6/2015

(Continued)

OTHER PUBLICATIONS

Translation of International Search Report for Application No. PCT/EP2019/077453 dated Dec. 18, 2019 (2 pages).

*Primary Examiner* — Xiao En Mo
(74) *Attorney, Agent, or Firm* — Michael Best & Friedrich LLP

(57) ABSTRACT

The invention relates to an injector arrangement (1) having an injector nozzle (2) for injecting medium into a combustion chamber (3), particularly for injecting fuel into a combustion chamber (3) of an internal combustion engine, and having a sealing ring (20), which is pre-loaded in order to seal against a sealing surface (6) of a cylinder head (4), which comprises a through-hole (5), through which the injection nozzle (2) protrudes into the combustion chamber (3) and in which, in the radial direction between the injection nozzle (2) and the cylinder head (4), a heat protection sleeve (10) is arranged, one end (11) of which, facing the combustion chamber (3), is frictionally connected to the injection nozzle (2) by a radial pressing (12). In order to functionally improve the injector arrangement (1), an end (13) of the heat protection sleeve (10) furthest from the combustion chamber (3) is frictionally connected to the sealing ring (20) by an axial pressing (14).

16 Claims, 3 Drawing Sheets

(56) References Cited

U.S. PATENT DOCUMENTS

| | | | | |
|---|---|---|---|---|
| 8,978,624 | B2 * | 3/2015 | Kamada | F02M 61/14 123/470 |
| 2007/0113828 | A1 * | 5/2007 | Fonville | F02M 53/04 123/470 |
| 2015/0040857 | A1 * | 2/2015 | Franks | F02M 61/14 123/294 |
| 2016/0138540 | A1 * | 5/2016 | Franks | F02M 61/14 123/470 |
| 2018/0328326 | A1 * | 11/2018 | Pfefferle | F02D 19/027 |

FOREIGN PATENT DOCUMENTS

| | | | |
|---|---|---|---|
| DE | 112014003643 | T5 | 5/2016 |
| EP | 3014105 | B1 | 8/2017 |
| WO | 0194775 | A1 | 12/2001 |
| WO | 2017029076 | A1 | 2/2017 |
| WO | 2017067855 | A1 | 4/2017 |

* cited by examiner

INJECTOR ARRANGEMENT

BACKGROUND OF THE INVENTION

The invention concerns an injector arrangement with an injector nozzle for injecting medium into a combustion chamber, in particular for injecting fuel into a combustion chamber of an internal combustion engine, and with a sealing ring which is preloaded in order to seal against a sealing face of a cylinder head comprising a passage hole, through which the injector nozzle protrudes into the combustion chamber and in which a heat protection sleeve is arranged in the radial direction between the injector nozzle and the cylinder head, one end of which sleeve facing the combustion chamber is connected by force fit to the injector nozzle by a radial press fit.

Austrian patent specification AT 512 667 B1 discloses an injector nozzle for injecting medium into a combustion chamber, in particular for injecting fuel into a combustion chamber of an internal combustion engine, comprising a nozzle body of which the nozzle tip having injection holes protrudes into the combustion chamber, with a heat protection sleeve which is arranged in the end region of the nozzle body on the combustion chamber side and surrounds the nozzle body; wherein the injector nozzle is inserted in a receiver bore of a holding part, in particular a cylinder head; wherein the end region of the nozzle body on the combustion chamber side cooperates with the receiver bore with the interposition of the heat protection sleeve; wherein the heat protection sleeve has a first and a second region which are axially spaced apart from one another, wherein the second region is arranged closer to the nozzle tip than the first region; wherein in the first region, a first outer circumferential sealing face is formed on the outer casing and a first inner circumferential sealing face on the inner casing surface, and in the second region a second outer circumferential sealing face is formed on the outer casing and a second inner circumferential sealing face on the inner casing; wherein the second sealing faces lie on a smaller diameter than the first sealing faces; wherein the first outer and the second outer sealing faces each cooperate in sealing fashion with an annular seating face running in a radial plane or with a conical seating face of the receiver bore, and the first inner and the second inner sealing faces each cooperate in sealing fashion with an annular seating face running in a radial plane or with a conical seating face of the nozzle body.

European patent specification EP 3 014 105 B1 discloses a fuel injector, in particular a common rail injector, with an injector housing which can be inserted in a receiver opening of the cylinder head of an internal combustion machine, and in the installation position has a first region facing a combustion chamber of the internal combustion engine, wherein said first region is adjoined on the side facing away from the combustion chamber by at least one second region of larger diameter; wherein the first region consists of metal and on the side facing the combustion chamber is surrounded radially by a first sealing element which can be inserted in the annular space between the first region of the injector housing and the receiver opening in the region of the first bore portion of the receiving bore; and with a second sealing element which can be clamped axially on the side facing away from the combustion chamber between the injector housing and a contact face of the receiver opening for the injector housing; wherein the first sealing element can be clamped axially between the injector housing and a second contact face of the receiver opening and is configured to seal the annular region between the injector housing and the receiver bore on the side of the first sealing element facing away from the first region; wherein the two sealing elements are formed on a component in the form of a sealing sleeve consisting of metal so that, on the end facing towards the combustion chamber, the sealing sleeve has a conically formed first sealing region as a first sealing element, while the flange-like peripheral edge on the other end face of the sealing sleeve forms a second sealing region or second sealing element.

The publication of the German translation DE 11 2014 003 643 T5 of international publication WO 2015/020790 discloses an internal combustion engine with a fuel injector arrangement for mounting in an engine cylinder head, comprising: an engine cylinder head sealing surface, a fuel injector body having a longitudinal axis, a nozzle element housing and a nozzle holder; and an injector sealing arrangement positioned between the fuel injector body and the engine cylinder head; wherein the injector sealing arrangement has a sealing component made of a first material and positioned in a longitudinal space formed between the fuel injector body and the engine cylinder head sealing surface in order to receive a fuel injector clamping force, and has a thermally conductive component formed from a second material which is different from the first material; wherein the second material has a higher thermal conductivity than the first material, and wherein the thermally conductive component is positioned radially between the nozzle element housing and the sealing component in order to transfer heat from the nozzle element housing to the sealing component.

SUMMARY OF THE INVENTION

It is an object of the invention to functionally improve an injector arrangement with an injector nozzle for injecting medium into a combustion chamber, in particular for injecting fuel into a combustion chamber of an internal combustion engine, and with a sealing ring which is preloaded in order to seal against a sealing face of a cylinder head comprising a passage hole, through which the injector nozzle protrudes into the combustion chamber and in which a heat protection sleeve is arranged in the radial direction between the injector nozzle and the cylinder head, one end of which sleeve facing the combustion chamber is connected by force fit to the injector nozzle by a radial press fit.

This object is achieved with an injector arrangement with an injector nozzle for injecting medium into a combustion chamber, in particular for injecting fuel into a combustion chamber of an internal combustion engine, and with a sealing ring which is preloaded in order to seal against a sealing face of a cylinder head comprising a passage hole, through which the injector nozzle protrudes into the combustion chamber and in which a heat protection sleeve is arranged in the radial direction between the injector nozzle and the cylinder head, one end of which sleeve facing the combustion chamber is connected by force fit to the injector nozzle by a radial press fit, in that an end of the heat protection sleeve facing away from the combustion chamber is connected by force fit to the sealing ring by an axial press fit. The injector nozzle is also called the injector and comprises a nozzle body in which a nozzle needle is movable forward and back in the direction of a longitudinal axis of the injector nozzle in order to open or close injection openings or injection holes, via which a medium such as high-pressure fuel can be injected into the combustion chamber. The terms "axial" and "radial" relate to the longitudinal axis of the injector nozzle. "Axial" means in the direction of or parallel to the longitudinal axis of the injector nozzle. "Radial" means transversely to the longitudinal axis of the injector nozzle. Advantageously, the injector arrangement is used in the operation of modern internal combustion engines to inject high-pressure fuel, in particular diesel fuel and/or gas, into the combustion chamber. In the tests and experiments performed in the context of the present invention, it was found that with a conventional injector arrangement, combustion gas can leak from the combustion chamber along a ring gap between the heat protection sleeve and the sealing ring into an annular chamber, on a side of the heat protection sleeve facing away from the combustion chamber. When the gas present in the annular chamber cools down, it may occur that aggressive media separate out of the combustion gas, wherein these media can cause corrosion on parts adjacent to the combustion chamber, which is undesirable. The axial press fit creates a tight connection between the heat protection sleeve and the sealing ring. Thus an undesirable passage of combustion gas between the heat protection sleeve and the sealing ring is securely prevented. Thus, in addition to the known heat dissipation function, a sealing function may also be implemented with the heat protection sleeve.

A preferred exemplary embodiment of the injector arrangement is characterized in that the heat protection sleeve is preloaded in the axial direction together with the sealing ring against the sealing face of the cylinder head. Thus via the heat protection sleeve, an axial press fit can be created between the sealing ring and the cylinder head. In this way, the seal against an undesirable passage of combustion gas out of the combustion chamber can be further improved.

A further preferred exemplary embodiment of the injector arrangement is characterized in that the end of the heat protection sleeve facing away from the combustion chamber has a radially outwardly protruding collar, via which the heat protection sleeve is connected by force fit to the sealing ring. "Radially outwardly" means that the collar of the heat protection sleeve points away from the longitudinal axis of the injector nozzle. Thus in a simple fashion, an axial press-fit connection is created between the heat protection sleeve and the sealing ring.

A further preferred exemplary embodiment of the injector arrangement is characterized in that an annular chamber, which is formed in the radial direction between the heat protection sleeve and the cylinder head, is delimited at its end facing away from the combustion chamber in the axial direction by the radially outwardly protruding collar of the heat protection sleeve. In this way, an undesirable passage of combustion gas from the combustion chamber, at the end of the annular chamber facing away from the combustion chamber, is securely prevented. At its end facing the combustion chamber, the annular chamber is open by design.

A further preferred exemplary embodiment of the injector arrangement is characterized in that the sealing ring has a radially inwardly protruding collar which is clamped in the axial direction between the radially outwardly protruding collar of the heat protection sleeve and the sealing face of the cylinder head. "Radially inwardly" means that the collar of the sealing ring points towards the longitudinal axis of the injector nozzle. The collar of the sealing ring preferably has a substantially rectangular ring cross-section. The collar of the heat protection sleeve advantageously also has a substantially rectangular ring cross-section. In a simple fashion, the two collars allow the creation of an axial press-fit connection between the sealing ring and the heat protection sleeve.

A further preferred exemplary embodiment of the injector arrangement is characterized in that a radial dimension of the inwardly protruding collar of the sealing ring is at least as large as the axial dimension of the radially outwardly protruding collar of the heat protection sleeve. The axial dimension of the radially inwardly protruding collar of the sealing ring is advantageously slightly larger than the radially outwardly protruding collar of the heat protection sleeve. The axial dimension of the entire sealing ring is advantageously slightly more than twice as large as the axial dimension of the heat protection sleeve.

A further preferred exemplary embodiment of the injector arrangement is characterized in that a radial play is present between the radially outwardly protruding collar of the heat protection sleeve and the sealing ring. In this way, the creation of a radial press-fit connection between the heat protection sleeve and the injector nozzle is simplified. Particularly advantageously, the heat protection sleeve is radially outwardly surrounded by an annular chamber. This annular chamber is delimited radially outwardly by the passage hole in the cylinder head and by the sealing ring.

A further preferred exemplary embodiment of the injector arrangement is characterized in that the heat protection sleeve comprises a sleeve body which has the form of a straight hollow cylinder with an inner casing surface, via which the heat protection sleeve bears over its entire axial dimension against an outer casing surface of the injector nozzle. In this way, an extremely stable radial press-fit connection is ensured between the injector nozzle and the heat protection sleeve. In addition, the entire inner casing surface of the heat protection sleeve may be used for heat transfer between the injector nozzle and the heat protection sleeve.

A further preferred exemplary embodiment of the injector arrangement is characterized in that the heat protection sleeve and the sealing ring are clamped in the axial direction between the sealing face of the cylinder head and a nozzle clamping nut. The radially outwardly protruding collar of the heat protection sleeve is clamped together with the radially inwardly protruding collar of the sealing ring between the sealing face of the cylinder head and the nozzle clamping nut. The nozzle clamping nut serves to mount the injector nozzle in the cylinder head in the known fashion.

The invention furthermore concerns a heat protection sleeve and/or a sealing ring for an injector arrangement as described above. The heat protection sleeve and the sealing ring may be provided separately.

The invention furthermore concerns a construction kit for an injector arrangement described above. The construction kit for the injector arrangement advantageously comprises various heat protection sleeves and sealing rings. Thus the injector arrangement may easily be adapted to different installation and/or operating conditions.

Further advantages, features and details of the invention arise from the following description in which various exemplary embodiments are described in detail with reference to the drawing.

DETAILED DESCRIPTION

Figure 1:
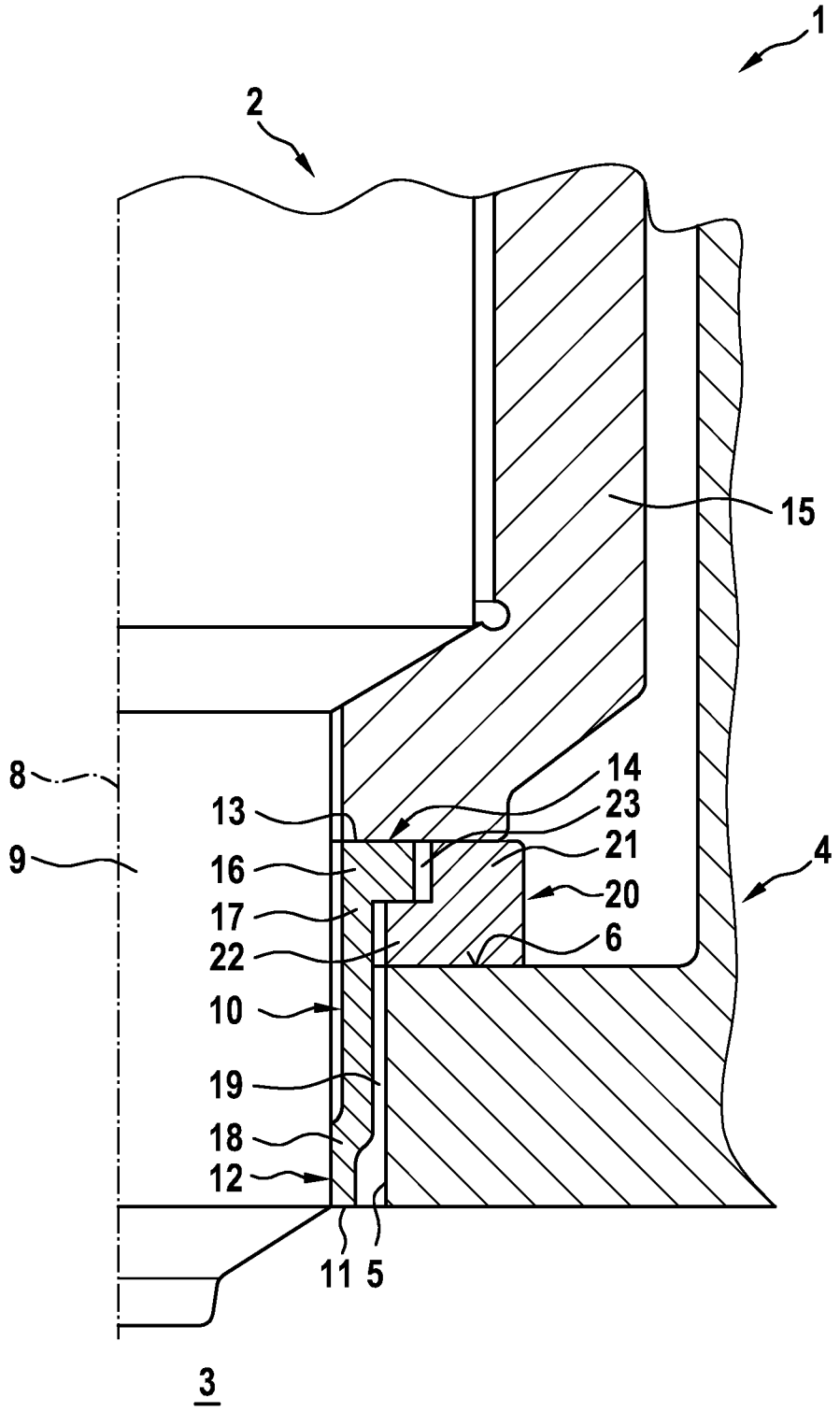
FIG. 1 in longitudinal section, an injector arrangement with an injector nozzle and a heat protection sleeve which is connected, at an end facing the cylinder chamber, by force fit to the injector nozzle by means of a radial press fit, wherein an end of the heat protection sleeve facing away from the combustion chamber is connected by force fit to a sealing ring by means of an axial press fit.
Figure 2:
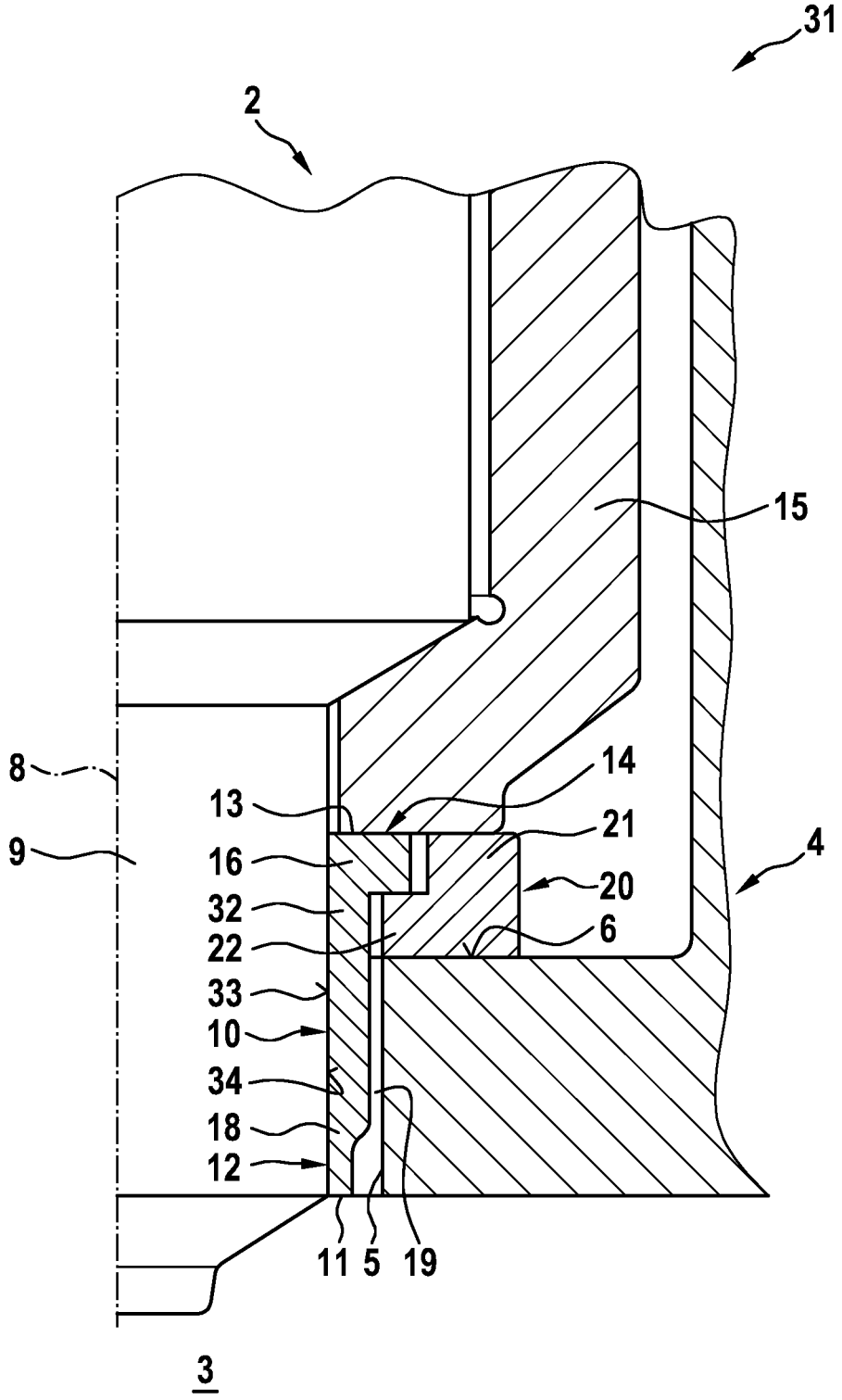
FIG. 2 an illustration similar to FIG. 1 with an optimized heat protection sleeve.
Figure 3:
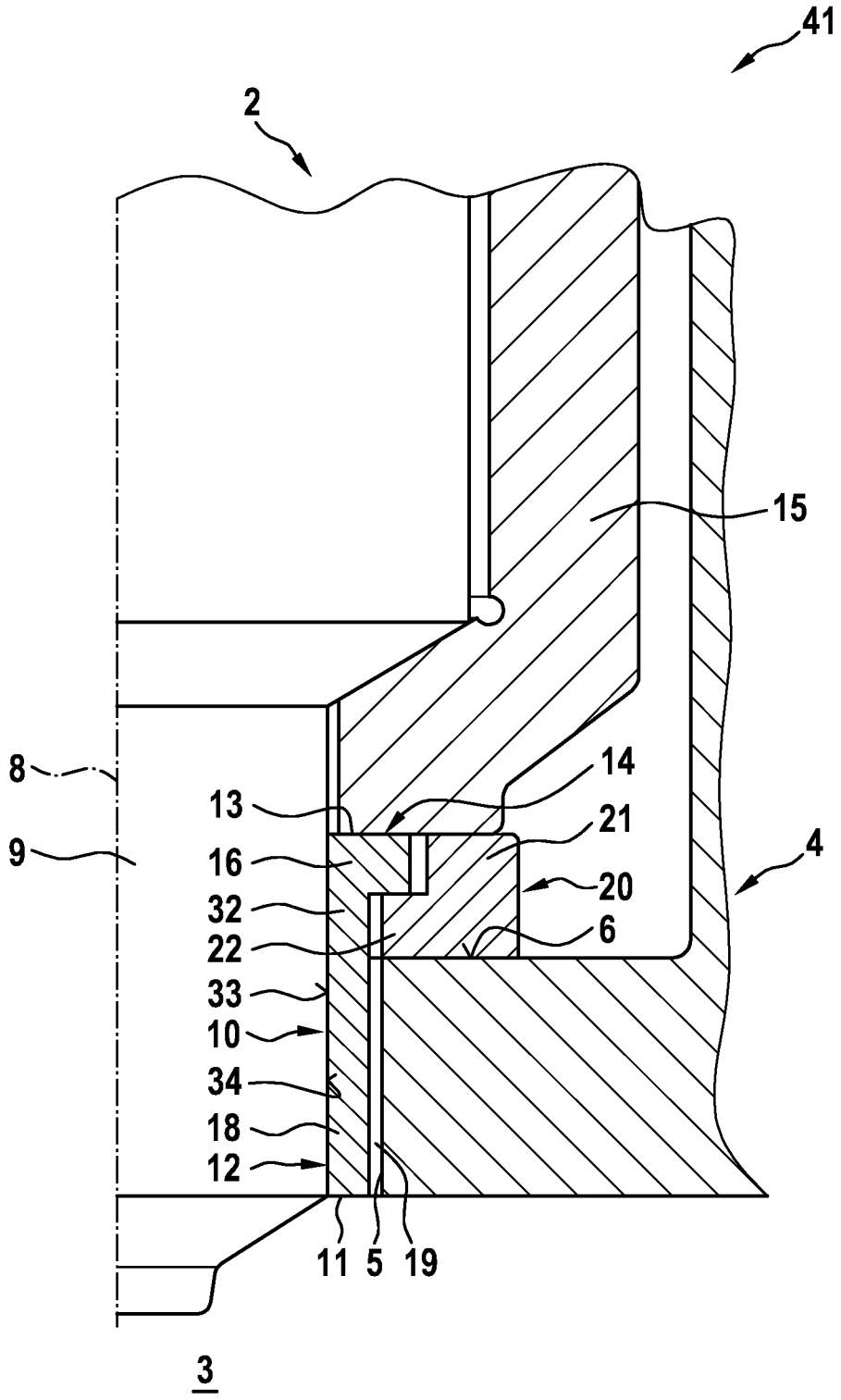
FIG. 3 an illustration similar to FIGS. 1 and 2 with a further optimized heat protection sleeve.

FIGS. 1 to 3 show an injector arrangement 1; 31; 41 in three similar embodiments, each in longitudinal section. The same reference signs are used to designate the same or similar components. Firstly, the common features of the embodiments are described. Then the differences between the individual embodiments are explained.

The injector arrangement 1; 31; 41 comprises an injector nozzle 2, which in FIGS. 1 to 3 protrudes with a lower end into a combustion chamber 3 of an internal combustion engine (not shown in detail). The internal combustion engine comprises a cylinder head 4 with a passage hole 5, through which the injector nozzle 2 protrudes into the combustion chamber 3.

The cylinder head 4 has a sealing face 6 facing away from the combustion chamber 3. The sealing face 6 extends in a plane perpendicular to a longitudinal axis 8 of the injector nozzle 2. The injector nozzle 2 comprises a nozzle body 9 in which a nozzle needle (not visible or not shown) can be moved forward and back in the direction of the longitudinal axis 8, in order to open or close fuel delivery holes or openings (also not visible or not shown) in the nozzle body 9.

The structure and function of the injector nozzle 2 may be the same as or similar to those of the fuel injector disclosed in European patent specification EP 3 014 105 B1 or the injector nozzle described in Austrian patent specification AT 512 667 B1.

In the known fashion, a heat protection sleeve 10 is assigned to the nozzle body 9 of the injector nozzle 2. The heat protection sleeve 10 is made from material with good thermal conductivity, for example a copper alloy. Heat from the nozzle tip of the injector nozzle 2 is dissipated via the heat protection sleeve 10.

An end 11 of the heat protection sleeve 10 facing the combustion chamber 3 is connected by force fit to the nozzle body 9 of the injector nozzle 2 by a radial press fit 12. An end 13 of the heat protection sleeve 10 facing away from the combustion chamber 3 is connected by force fit to a nozzle clamping nut 15 and a sealing ring 20 by an axial press fit 14. The sealing ring 20 is in turn connected to the cylinder head 4 by force fit. The nozzle clamping nut 15 serves to mount the injector nozzle 2 in the cylinder head 4 in the known fashion.

At its end 13 facing away from the combustion chamber 3, the heat protection sleeve 10 has a collar 16. The collar 16 extends radially outwardly from a base body 17 of the heat protection sleeve 10. The base body 17 of the heat protection sleeve 10 has substantially the form of a straight hollow cylinder. The collar 16 has a rectangular ring cross-section. At its end 11 facing the combustion chamber 3, the heat protection sleeve 10 has an end portion 18 of reduced diameter.

The end portion 18 of reduced diameter serves to create the radial press fit 12 between the heat protection sleeve 10 and the injector nozzle 2. The collar 16 of the heat protection sleeve 10 serves to create the axial press fit between the heat protection sleeve 10 and the sealing ring 20.

The passage hole 5 in the cylinder head 4, together with the sealing ring 20, radially outwardly delimits an annular chamber 19 which is delimited radially inwardly by the heat protection sleeve 10. The annular chamber 19 is open towards the combustion chamber 3. At its end facing away from the combustion chamber 3, the annular chamber 19 is delimited by the collar 16 of the heat protection sleeve 10.

The sealing ring 20 comprises a base body 21 with a rectangular ring cross-section. A collar 22 extends radially inwardly from the base body 21 of the sealing ring 20. The collar 22 of the sealing ring 20 is clamped by force fit in the axial direction between the collar 16 of the heat protection sleeve 10 and the sealing face 6 of the cylinder head 4.

The axial press fit 14 connects the heat protection sleeve 10 by force fit to the sealing ring 20, which itself is connected by force fit to the cylinder head 4. In this way, an axial press-fit connection is created which securely prevents combustion gas from escaping from the combustion chamber 3, through the annular chamber 19, into a structurally provided annular chamber 23.

The annular chamber 23 in FIGS. 1 to 3 is delimited axially at the bottom by the collar 22 of the sealing ring 20. The annular chamber 23 is delimited axially at the top by the nozzle clamping nut 15. The annular chamber 23 results from a structurally required radial play between the collar 16 of the heat protection sleeve 10 and the base body 21 of the sealing ring 20.

In the injector arrangements 31; 41 of FIGS. 2 and 3, the heat protection sleeve 10 comprises a sleeve body 32 which has the form of a straight hollow cylinder. An inner casing surface 33 of the sleeve body 32 bears over its entire axial dimension (also known as the length) on an outer casing surface 34 of the nozzle body 9 of the injector nozzle 2 by force fit, in order to create the radial press fit 12. At its end 11 facing the combustion chamber 3, the sleeve body 32 has an end portion 18 of reduced diameter.

In the injector arrangement 41 in FIG. 3, in contrast to FIG. 2, the sleeve body 32 is designed without the end portion 18 of reduced diameter. Otherwise, the heat protection sleeve 10 in FIG. 3 is designed in the same fashion as in FIG. 2.

What is claimed is:

1. An injector arrangement (1; 31; 41) with an injector nozzle (2) for injecting medium into a combustion chamber (3), in and with a sealing ring (20) which is preloaded in order to seal against a sealing face (6) of a cylinder head (4) comprising a passage hole (5), through which the injector nozzle (2) protrudes into the combustion chamber (3) and in which a heat protection sleeve (10) is arranged in a radial direction between the injector nozzle (2) and the cylinder head (4), one end (11) of which heat protection sleeve facing the combustion chamber (3) is connected by force fit to the injector nozzle (2) by a radial press fit (12), characterized in that an end (13) of the heat protection sleeve (10) facing away from the combustion chamber (3) is clamped in an axial direction against the sealing ring (20), wherein the end (13) of the heat protection sleeve (10) facing away from the combustion chamber (3) has a radially outwardly protruding collar (16), via which the heat protection sleeve (10) is clamped in the axial direction against the sealing ring (20), and wherein the sealing ring (20) has a radially inwardly protruding collar (22) which is clamped in the axial direction by the radially outwardly protruding collar (16) of the heat protection sleeve (10) against the sealing face (6) of the cylinder head (4).

2. The injector arrangement as claimed in claim 1, characterized in that the heat protection sleeve (10) is preloaded in the axial direction together with the sealing ring (20) against the sealing face (6) of the cylinder head (4).

3. The injector arrangement as claimed in claim 1, characterized in that an annular chamber (19), which is formed in the radial direction between the heat protection sleeve (10) and the cylinder head (4), is delimited at its end (13) facing away from the combustion chamber (3) in the axial direction by the radially outwardly protruding collar (16) of the heat protection sleeve (10).

4. The injector arrangement as claimed in claim 1, characterized in that an axial dimension of the radially inwardly protruding collar (12) of the sealing ring (20) is at least as large as an axial dimension of the radially outwardly protruding collar (16) of the heat protection sleeve (10).

5. The injector arrangement as claimed in claim 1, characterized in that a radial play is present between the radially outwardly protruding collar (16) of the heat protection sleeve (10) and the sealing ring (20).

6. The injector arrangement as claimed in claim 1, characterized in that the heat protection sleeve (10) comprises a sleeve body (32) which has the form of a straight hollow cylinder with an inner casing surface (33), via which the heat protection sleeve (10) is pressed over an entire axial dimension against an outer casing surface (34) of the injector nozzle (2).

7. The injector arrangement as claimed in claim 1, characterized in that the heat protection sleeve (10) and the sealing ring (20) are clamped in an axial direction against the sealing face (6) of the cylinder head (4) by a nozzle clamping nut (15).

8. An internal combustion engine comprising a combustion chamber (3), a cylinder head (4) including a sealing face (6) and a passage hole (5), and an injector arrangement (1; 31; 41) including an injector nozzle (2) for injecting fuel into the combustion chamber (3), the injector nozzle protruding into the combustion chamber through the passage hole, a sealing ring (20) which is preloaded in order to seal against the sealing face (6) of the cylinder head (4), and a heat protection sleeve (10) arranged in the passage hole in a radial direction between the injector nozzle (2) and the cylinder head (4), one end (11) of the heat protection sleeve facing the combustion chamber (3) being connected by force fit to the injector nozzle (2) by a radial press fit (12), and a clamping means clamps an end (13) of the heat protection sleeve (10) facing away from the combustion chamber (3) in an axial direction against the sealing ring (20).

9. The internal combustion engine as claimed in claim 8, characterized in that the heat protection sleeve (10) is preloaded in the axial direction together with the sealing ring (20) against the sealing face (6) of the cylinder head (4).

10. The internal combustion engine as claimed in claim 8, characterized in that the end (13) of the heat protection sleeve (10) facing away from the combustion chamber (3) has a radially outwardly protruding collar (16), via which the clamping means presses the heat protection sleeve (10) against the sealing ring (20).

11. The internal combustion engine as claimed in claim 10, characterized in that an annular chamber (19), which is formed in the radial direction between the heat protection sleeve (10) and the cylinder head (4), is delimited at its end (13) facing away from the combustion chamber (3) in the axial direction by the radially outwardly protruding collar (16) of the heat protection sleeve (10).

12. The internal combustion engine as claimed in claim 10, characterized in that the sealing ring (20) has a radially inwardly protruding collar (22) which is clamped in the axial direction by the clamping means between the radially outwardly protruding collar (16) of the heat protection sleeve (10) and the sealing face (6) of the cylinder head (4).

13. The internal combustion engine as claimed in claim 12, characterized in that an axial dimension of the radially inwardly protruding collar (12) of the sealing ring (20) is at least as large as an axial dimension of the radially outwardly protruding collar (16) of the heat protection sleeve (10).

14. The internal combustion engine as claimed in claim 10, characterized in that a radial play is present between the radially outwardly protruding collar (16) of the heat protection sleeve (10) and the sealing ring (20).

15. The internal combustion engine as claimed in claim 8, characterized in that the heat protection sleeve (10) comprises a sleeve body (32) which has the form of a straight hollow cylinder with an inner casing surface (33), via which the heat protection sleeve (10) is pressed over an entire axial dimension against an outer casing surface (34) of the injector nozzle (2).

16. The internal combustion engine as claimed in claim 8, wherein the clamping means is a nozzle clamping nut (15), and wherein the heat protection sleeve (10) and the sealing ring (20) are clamped in the axial direction against the sealing face (6) of the cylinder head (4) by the nozzle clamping nut (15).

* * * * *